US010351973B2

(12) United States Patent
Kolstad et al.

(10) Patent No.: US 10,351,973 B2
(45) Date of Patent: Jul. 16, 2019

(54) PROCESS FOR THE PREPARATION OF A FIBER, A FIBER AND A YARN MADE FROM SUCH A FIBER

(71) Applicant: FURANIX TECHNOLOGIES B.V., Amsterdam (NL)

(72) Inventors: Jeffrey John Kolstad, Amsterdam (NL); Gerardus Johannes Maria Gruter, Amsterdam (NL)

(73) Assignee: FURANIX TECHNOLOGIES B.V., Amsterdam (NL)

( * ) Notice: Subject to any disclaimer, the term of this patent is extended or adjusted under 35 U.S.C. 154(b) by 446 days.

(21) Appl. No.: 14/899,832

(22) PCT Filed: Jun. 20, 2014

(86) PCT No.: PCT/NL2014/050407
§ 371 (c)(1),
(2) Date: Dec. 18, 2015

(87) PCT Pub. No.: WO2014/204313
PCT Pub. Date: Dec. 24, 2014

(65) Prior Publication Data

US 2016/0138193 A1 May 19, 2016

Related U.S. Application Data

(60) Provisional application No. 61/837,232, filed on Jun. 20, 2013.

(30) Foreign Application Priority Data

Jun. 20, 2013 (NL) ..... 2011016

(51) Int. Cl.

| | |
|---|---|
| ***D01D 5/08*** | (2006.01) |
| ***D01D 5/088*** | (2006.01) |
| ***D01F 6/62*** | (2006.01) |
| ***D06P 3/52*** | (2006.01) |
| ***D01F 6/84*** | (2006.01) |
| ***D01F 6/94*** | (2006.01) |

(52) U.S. Cl.
CPC ..... *D01D 5/088* (2013.01); *D01F 6/62* (2013.01); *D01F 6/84* (2013.01); *D01F 6/94* (2013.01); *D06P 3/52* (2013.01); *D01D 5/08* (2013.01); *D10B 2321/021* (2013.01); *D10B 2331/04* (2013.01); *D10B 2401/06* (2013.01)

(58) Field of Classification Search
CPC .. D01D 5/088; D01F 6/62; D01F 6/84; D01F 6/94; D06P 3/52; D10B 2321/021; D10B 2331/04; D10B 2401/06
See application file for complete search history.

(56) References Cited

U.S. PATENT DOCUMENTS

| | | | |
|---|---|---|---|
| 6,063,495 | A | 5/2000 | Charbonneau et al. |
| 2006/0014920 | A1 | 1/2006 | Shirakawa et al. |
| 2009/0124763 | A1 | 5/2009 | Matsuda et al. |
| 2012/0238170 | A1 | 9/2012 | Weisman et al. |
| 2012/0238981 | A1 | 9/2012 | Weisman et al. |
| 2012/0302768 | A1 | 11/2012 | Janka et al. |
| 2013/0023608 | A1 | 1/2013 | Kellett et al. |

FOREIGN PATENT DOCUMENTS

| | | | | |
|---|---|---|---|---|
| CN | 85107349 | A | | 4/1987 |
| GB | 621971 | A | | 4/1949 |
| JP | 2009215467 | | * | 9/2009 |
| JP | 2011-63895 | A | | 3/2011 |
| WO | WO 2010/077133 | A1 | | 7/2010 |
| WO | WO 2010/132740 | A2 | | 11/2010 |
| WO | WO 2011/043660 | A2 | | 4/2011 |
| WO | WO 2011/043661 | A1 | | 4/2011 |
| WO | WO 2013/062408 | A1 | | 5/2013 |
| WO | WO 2013/149157 | A1 | | 10/2013 |
| WO | WO 2013/149222 | A1 | | 10/2013 |

OTHER PUBLICATIONS

Chen et al., "Preparation of 2,5-furandicarboxylic acid-based polyester used for making fiber and package, by esterifying 2,5-furandicarboxylic acid and dihydric alcohol in the presence of catalyst, and polycondensing esterified product", WPI/Thomson, Dec. 1, 2010, vol. 2011, No. 21, XP002699110, Abstract.
International Search Report, issued in PCT/NL2014/050407, dated Sep. 17, 2014.
Search Report issued in the Netherlands Priority Application No. 2011016, dated Oct. 21, 2013.
Heertjes et al., "Polycondensation products of 2,5-furandicarboxylic acid," Delft Progress Report, Series A: Chemistry and Physics, Chemical and Physical Engineering, vol. 1, 1974, pp. 59-63.
Japanese Office Action for Japanese Application No. 2016-521243, dated Jun. 4, 2018, with English translation.

* cited by examiner

*Primary Examiner* — Cephia D Toomer
(74) *Attorney, Agent, or Firm* — Birch, Stewart, Kolasch & Birch, LLP

(57) ABSTRACT

A fiber comprising polyethylene-2,5-furan-dicarboxylate, is prepared by melt spinning in a process wherein a molten composition comprising polyethylene-2,5-furan-dicarboxylate having an intrinsic viscosity of at least 0.55 dl/g, determined in dichloroacetic acid at 25° C., is passed through one or more spinning openings to yield molten threads; wherein the molten threads are cooled to below the melting temperature of the composition to yield spun fibers; and wherein the spun fibers are drawn to a linear density in the range of 0.05 to 2.0 tex per fiber. The invention also proves a fiber comprising polyethylene-2,5-furan-dicarboxylate having a linear density of 0.05 to 2.0 tex, wherein the polyethylene-2,5-furan-dicarboxylate has an intrinsic viscosity of at least 0.45 dl/g, determined in dichloroacetic acid at 25° C.

31 Claims, No Drawings

PROCESS FOR THE PREPARATION OF A FIBER, A FIBER AND A YARN MADE FROM SUCH A FIBER

CROSS REFERENCE TO RELATED APPLICATIONS

This application is the National Phase of PCT International Application No. PCT/NL2014/050407, filed on Jun. 20, 2014, which claims priority under 35 U.S.C. 119(e) to U.S. Provisional Application No. 61/837,232, filed on Jun. 20, 2013 and under 35 U.S.C. 119(a) to Patent Application No. 2011016, filed in The Netherlands on Jun. 20, 2013, all of which are hereby expressly incorporated by reference into the present application.

The present invention relates to a process for the preparation of a fiber, a fiber and a yarn made from such a fiber. In particular it relates to a process for preparing a fiber comprising polyethylene-2,5-furan-dicarboxylate ("PEF") by melt spinning.

2,5-Furan-dicarboxylic acid ("FDCA") is a natural di-acid that is produced in the human body. Routes for its preparation using air oxidation of 2,5-disubstituted furans such as 5-hydroxymethylfurfural or 5-alkoxymethylfurfural with catalysts comprising Co, Mn and/or Ce were reported in WO2010/132740, WO2011/043660, WO2011/043661 and US 2012/0302768. The diacid is stated to be a suitable monomer for the preparation of polyesters, such as polyalkylene-2,5-furandicarboxylate. Examples for the preparation of such polyesters have been described in US 2009/0124763. Such polyesters have the drawback that they tend to be unintentionally colored. That is in line with color of the polyesters that were described in other prior art documents. The preparation of colorless polyesters with a high molecular weight has been described in WO2010/077133. The colorless nature is allegedly due to the catalyst used. The high molecular weight is achieved by including a solid state polymerisation step in the polymerisation process. The latter document also mentions that the polyester may be used in a fiber.

According to GB 621971 polyesters and polyester-amides can be prepared by reacting glycols with dicarboxylic acids of which at least one contains a heterocyclic ring. As an example of a glycol ethylene glycol is mentioned and as an example of such a heterocyclic diacid, 2,5-furan-dicarboxylic acid is mentioned. GB 621971 describes the preparation of polyethylene-2,5-furandicarboxylate from the polymerisation of ethylene glycol and 2,5-dfurandicarboxylic acid and the methyl ester thereof. The product had a reported melting point of 205-210° C. and readily yielded filaments from the melt. No additional properties were reported.

The fact that these polyesters were colored is confirmed by Heertjes et al. in Delft Progr. Rep., Series A: Chemistry and physics, chemical and physical engineering, 1 (1974) 59-63. This article not only teaches that such polyesters are yellow to brown in color, but that they are also thermally not so stable. Moreover, the molecular weight of the polyesters obtained is rather low, and does not exceed an intrinsic viscosity of 0.6 for the polyethylene-2,5-furan-dicarboxylate.

US2012/0238981 discloses polyesters for a fibrous web. In particular it describes polyester terephthalate fibers that have been obtained using high speed fiber spinning and that have a fiber denier of at least 2.9 and a peak fiber load of at least 10.0. Denier is a textile measurement unit and expresses the linear mass density, the mass of a filament of 9000 meters length. Another parameter often used is tex, the mass of a filament of 1000 meters length. So, 1 tex is 9 denier. The molecular weight of the polyesters may range within wide ranges and may be as low as 5,000 (Mn). For different polyesters different molecular weights are suitable. PEF is a suggested alternative, but no actual examples of PEF fibers are disclosed.

WO2013/149222 and WO2013/149157 describe a single filament made from a PEF resin with a number average molecular weight of 20,100 and a PDI of 1.93, resulting in a weight average molecular weight of about 38,800. The resulting fiber had a denier of 10 (~1.1 tex). For the resulting material no fiber related parameters were provided. The filament described in WO2013/149222 and WO2013/149157 appears not to have a measurable tenacity.

The present invention provides a process for the preparation of a fiber containing polyethylene-2,5-furan-dicarboxylate by melt spinning, which fiber has excellent mechanical properties when the polyester is colorless when no dye or colorant was deliberately added, and when the polyester has a relatively high molecular weight. The polyester can then be drawn after spinning to a low linear density in the range of 0.05 to 2.0 tex per filament and then shows a remarkably high tenacity. It was found that when other diols, such as 1,3-propane diol, were used in the preparation of a polyester, the polyester did not show the same level of tenacity after having been drawn to a similar linear density.

Accordingly, the present invention provides for a process for the preparation of a fiber comprising polyethylene-2,5-furan-dicarboxylate, by melt spinning wherein a molten composition comprising polyethylene-2,5-furan-dicarboxylate having an intrinsic viscosity of at least 0.55 dl/g, determined in dichloroacetic acid at 25° C., is passed through one or more spinning openings to yield molten threads;

wherein the molten threads are cooled to below the melting temperature of the composition to yield spun fibers; and wherein the spun fibers are drawn to a linear density in the range of 0.05 to 2.0 tex per fiber.

Melt spinning is a well-known process. Sometimes the process is divided in a number of types of melt spinning.

In traditional methods of melt spinning fibers are formed by extruding a molten thermoplastic material through a plurality of fine, usually circular, die capillaries (a spinneret) as molten threads. These move downward through an area of controlled temperature where the molten threads are cooled to below the melting temperature of the thermoplastic material, and are eventually brought into contact with a spinning roller. This spinning roller (also known as the filament take-up roll) can provide an acceleration of the molten filaments as they leave the die capillaries. This filament take up roll may then be followed by one or more additional rollers and winders to further condition, draw, and wind the fiber. Depending on the speed of the filament take-up roll the process can be used to produce yarns with different orientation levels. This process is typically used to produce fibers of very long, essentially continuous, length. If the yarn is also subsequently chopped into discrete lengths it can be used to produce a so-called staple fiber. These staple fibers can then be used either alone or in combination with other types of staple fibers and put through a "yarn spinning" process to produce yarn, such as is used to produce yarn from natural fibers such as those of cotton, wool or silk. The staple fibers can also be laid down in the form of a web or mat and entangled by a variety of means and chemically or thermally bonded to form a non-woven material. Meltblowing refers to a process for making continuous fibers, generally as described above, wherein the fibers are formed by extruding a molten thermoplastic material through a spinneret into converging high velocity, usually heated, gas (for example air) streams which attenuate the threads of molten thermoplastic material to reduce their diameter. Another type of melt spinning is known as spunbonding. The extrusion process is similar to the production of continuous filaments and uses similar extruder conditions for a given polymer. Fibers are formed as the molten polymer exits the spinneret and is quenched by cool gas, e.g. air. The objective of the process is to produce a wide web and, therefore, many spinnerets may be placed side by side. Before deposition on a moving belt or screen, the output of a spinneret, i.e. individual filaments, is attenuated to orient molecular chains within the fibers to increase fiber strength. This is accomplished by rapidly stretching (drawing) the fibers after exiting the spinneret. In practice the fibers are usually pneumatically accelerated in multiple fiber bundles.

When the molten composition is passed through the spinneret holes and the fibers are brought together as a bundle and passed several times over a roller, an acceleration is provided by the speed of the roller which may be higher than the speed with which the fibers leave the spinneret. The ratio of the roller speed to the extrusion velocity of the spinneret is known as the spin draft. When the spin draft is greater than one, a certain drawing already takes place. Suitable values of spin draft are 60-600 to produce yarns with sufficient orientation and initial drawing that are suitable for further drawing. In a spunbond type process the acceleration is provided by the gases at the pneumatical acceleration. It is evident that in all cases the spun fibers are drawn.

The holes in a spinneret typically have a diameter of 0.1 to 0.8 mm. In view of the small size of the holes, the molten composition must be free from impurities and is typically filtered before being passed through the holes. The holes have a certain length. The length of the channel (L) in the spinneret is usually selected in relation to the diameter (D) of the hole. The L/D ratio is suitably in the range of 1 to 4.

As indicated above, the holes are typically circular. Other shapes, however, such as trigonal, multilobal, square or cross-like, are possible.

After leaving the spinning openings of the spinneret the molten threads are cooled. Such is typically done in a quench zone where the threads are contacted with gas, such as air. The air may be cooled, but also air at room temperature, i.e. around 20 to 25° C., and even heated air may be used.

It has been found that the process of the present invention enables the skilled person to prepare fibers containing polyethylene-2,5-furan-dicarboxylate from a wide range of polymer mixtures. It is possible to draw fibers according to the present invention from a polymer consisting completely of polyethylene-2,5-furan-dicarboxylate. Thus, the molten composition suitably comprises at least 75% wt, preferably up to 100% wt of polyethylene-2,5-furan-dicarboxylate, based on the weight of the molten composition. However, it is also possible to subject mixtures of other polymers with polyethylene-2,5-furan-dicarboxylate to the process according to the present invention. Such other polymers, different from polyethylene-2,5-furan-dicarboxylate, include polyolefins, such as polyethylene and polypropylene, polyamides, such as nylon-6,6 and nylon-6, and polyesters, such as polylactic acid, (PLA), polyethylene terephthalate (PET) and polyethylene-naphthalate (PEN). Especially mixtures with PET or PEN are preferred for technical reasons, such as retention and even improvement of tenacity. Such other polymers may form the basis of the molten composition to which polyethylene-2,5-furan-dicarboxylate is added as a minority component. In such case the properties of the other polymer may be retained or even improved. Suitably the molten composition then comprises 99 to 75% wt of the other polymer and 1 to 25% wt of polyethylene-2,5-furan-dicarboxylate, based on the weight of the polymers in the molten composition. Alternatively, another polymer may be added to the polyethylene-2,5-furan-dicarboxylate. Therefore, the molten composition suitably comprises from 0 to 25% wt, preferably from 1 to 25% wt, of such other polymer and from 75 to 100% wt polyethylene-2,5-furan-dicarboxylate, based on the weight of the polymers in the molten composition. Accordingly, the at least one polymer different from polyethylene-2,5-furan-dicarboxylate is preferably present in an amount of 99 to 75% wt or 1 to 25% wt, based on the weight of the at least one polymer different from polyethylene-2,5-furan-dicarboxylate and polyethylene-2,5-furan-dicarboxylate. When the molten composition comprises another polymer, it may enable the skilled person to adjust the properties of the resulting fibers in accordance with the properties of the other polymer. In this way it may become possible to combine the best properties of the other polymer or polymers with those of polyethylene-2,5-furan-dicarboxylate. Therefore, the molten composition preferably further comprises at least one polymer different from polyethylene-2,5-furan-dicarboxylate. As indicated above, the preferred other polymer is PET or PEN. Thus, the molten composition advantageously further comprises polyethylene terephthalate or polyethylene naphthalate, preferably in an amount of 99 to 85% wt, more preferably from 99 to 90% wt, based on the total composition. It has been found that the present invention makes it possible to recycle PET and combine the recycled PET with amounts of suitably up to 15% wt of polyethylene-2,5-furan-dicarboxylate, without deteriorating the PET properties, and at the same time providing the mixture obtained with the properties of polyethylene-2,5-furan-dicarboxylate. In this way an excellent fiber is obtained that partly may consist of biobased material, which reduces the carbon footprint of such fibers.

The skilled person will realize that it may not only be possible to use blends of polymers in the molten composition, but that it is also feasible to make multicomponent fibers, comprising two or more different polymeric components or sub-fibers within a single fiber. Typically each component is extruded from a separate extruder. When two components are used, the fiber is called a bicomponent. Examples include side-by-side, sheath-core, matrix fibril, island in the sea and pie slice configurations.

Applicants believe that certain of the multicomponent fibers will be found to have preferred characteristics. For example, a side-by-side fiber comprised of a PET segment and a segment of polyethylene-2,5-furan-dicarboxylate may have preferential bulking tendency due to curling caused by differential shrinkage of the two components. Also, such a fiber may be used to create subtle changes in visual appearance of a yarn, due to the likely small changes in dyeability. Since both components of the fiber have a similar melting point of above 200° C., the fiber may be processed at a high speed and the ironability of any textiles produced from such fiber will not be adversely affected. It may also be desirable to have a fiber which is primarily biobased, but which still exhibits the very high melting point of a conventional PET fiber or surface finish of a PET fiber. In such a case, a sheath core construction could be used, with a core of polyethylene-2,5-furan-dicarboxylate and a sheath of PET. Such a construction could be up to 70%, 80% or even up to 90% or more of the polyethylene-2,5-furan-dicarboxylate biobased material, while retain the surface and processing characteristics of the conventional PET based fiber. It may further be desirable to have a textured fully biobased fiber with side by side construction. A bicomponent fiber with polyethylene-2,5-furan-dicarboxylate and a second biobased polymer, such as PLA, polytri- or polytetramethylene-2,5-furan-dicarboxylate or other furanic polyesters, can be arranged in a side-by-side type structure to create such an effect. It may also be desirable to have a microdenier biobased fiber with excellent thermal and hydrolytic stability. Such a microdenier fiber might be made through a bicomponent structure, wherein a material which is hydrolytically unstable, such as PLA, is used as a matrix for islands of polyethylene-2,5-furan-dicarboxylate fiber in an island in the sea construction. The PLA material would then be hydrolysed or reacted away, leaving a microdenier fiber of PEF. A "peelable" pie slice structure might also be used, where small pie slices of polyethylene-2,5-furan-dicarboxylate are subsequently freed to form a microdenier fiber.

In accordance with the process of the present invention, the spun fibers, obtained after cooling the molten threads, are drawn to the desired linear density. As described above, this can be done immediately after the exit from the openings of the spinneret as part of the continuous extrusion process, but also in a post-draw step in a secondary drawing step. The spun fibers before drawing tend to be comprised of polymer chains with relatively low orientation. By drawing (also known as stretching) the spun fibers the polymer chains get into a higher degree of orientation and crystallization. It has been found that good mechanical properties are obtained due to the orientation and crystallization of the polyethylene-2,5-furan-dicarboxylate when the spun fibers are drawn at a draw ratio of 1:1.4 to 1:6.0 in the secondary drawing step. By draw ratio is understood a measure of the degree of stretching (or drawing) during the orientation of a fiber, expressed as the ratio of the cross-sectional area of the undrawn material to that of the drawn material. In this specification, by fiber is meant a monofilament. It is evident that in the majority of applications fibers are used in the form of multifilaments. In the context of this specification a multifilament combination of fibers will be referred to as yarn. The spun fibers are suitably combined to a multifilament yarn before or after being drawn. In the more preferred case, the drawing is conducted on a multifilament yarn.

The melting temperature of polyethylene-2,5-furan-dicarboxylate is typically in the range of 190 to 230° C. Therefore, the composition according to the present process is suitably brought to and maintained at a temperature ranging from 250 to 300° C., in particular from 260 to 290° C., to keep the composition in a molten state and bring it to a viscosity that is suitable for extrusion through the holes of the spinneret. The temperature is suitably at least 20° C., more preferably at least 30° C., above the melting point of the polymer composition. Suitably this is done at 20 to 70° C., above the melting point of the polymer composition. It is understood that by the melting point of the polymer composition in the case of a blend of polymers, the melting point of the polymer with the highest melting temperature is meant. The molten threads, extruded at a temperature above the melting point of the molten composition, are cooled to a temperature below this melting point. Suitably they are cooled to a temperature below the glass transition temperature of the polymer composition. Although some drawing may have already been accomplished at this stage due to attenuation or spin draft, it is desirable to further draw the fibers thus obtained.

The thus obtained fibers are preferably drawn at a temperature below the melting point of the composition in a secondary drawing step. Suitably these fibers are drawn at an ambient temperature of 50 to 180° C. It was found that at relatively low draw temperatures the tenacity of the resulting fiber was improved compared to higher draw temperatures. Accordingly, it is preferred that the temperature at which the spun fibers are drawn is at least 25° C. below the melting temperature of the composition, more preferably, between 40 and 150° C. below the melting temperature of the composition. Typically, this will be between the glass transition temperature and the melting temperature of the polymer composition. This may suitably result in a preferred temperature at which the fibers are drawn in the range of 80 to 150° C.

The composition that is used in the process of the present invention contains polyethylene-2,5-furan-dicarboxylate. The molecular weight of this polymer is relatively high but may vary between wide ranges. In general the weight average molecular weight of the polyethylene-2,5-furan-dicarboxylate in the molten composition is in the range of 55,000 to 200,000, preferably from 62,000 to 180,000, more preferably from 65,000 to 150,000. The weight average molecular weight can be determined by GPC using polystyrene standards The weight average molecular weight can be correlated to the intrinsic viscosity (IV), measured in dichloroacetic acid in a concentration of 1 gram per 200 ml dichloroacetic acid at 25° C. In an Ubbelohde viscosimeter the time for the sample to elute is measured and a correlated with the time for the dichloroacetic acid solvent alone to elute, yielding a relative viscosity. Therefrom the intrinsic viscosity can be determined. For polyethylene-2,5-furandicarboxylate, the IV can be calculated as $IV=-5.534+5.747*\sqrt{(0.579+0.348*\eta_{ref})}$, wherein $\eta_{ref}$ the relative viscosity. An IV for polyethylene-2,5-furan-dicarboxylate of 0.58 corresponds with a weight average molecular weight of 55,000, and an IV of 1.55 corresponds with a weight average molecular weight of 200,000. Therefore, the IV is suitably in the range of 0.55 to 1.55 dl/g. The intermediate molecular weights may be determined via a relationship $$IV=1.45*10^{-4}*Mw^{0.76},$$

wherein Mw represents the weight average molecular weight. It has been found that the polymers with a relatively high molecular weight result in fibers showing a higher tenacity than the polymers having a lower molecular weight. Therefore, the molecular weight of the polyethylene-2,5-furandicarboxylate in the molten composition is preferably at least 100,000, e.g. in the range of 100,000 to 150,000.

In this respect it is observed that the molecular weight may slightly change during the spinning process. Such a change may result in fibers that after drawing contain polymers with a lower molecular weight than the molecular weight of the polymers in the molten composition. Such an amendment may be caused by a thermal reaction. The result is not only apparent from a lower molecular weight, but also from a narrower polydispersity index (PDI) which is the ratio between the weight average molecular weight and the number average molecular weight.

Fibers and yarns may be used as prepared by the process according to the invention after drawing. Yarns may also be textured, either in part of a continuous spinning process as described above, or in a subsequent process. For continuous yarns typically used in apparel, a number of texturing processes may be employed either in a textile factory or by the fiber producer. Texturing is the formation of crimp, loops, coils, or crinkles in filaments. Such changes in the physical form of a fiber affect the hand of fabrics made from them. Hand, or handle, is a general term for the characteristics perceived by the sense of touch when a fabric is held in the hand, such as drapability, softness, elasticity, coolness or warmth, stiffness, roughness, and resilience. Most apparel texturizing techniques are high-speed processes. The spun fibers obtained by the current process are preferably textured. Such texturing can be done via techniques that are known in the art. Such techniques include the introduction of crimping, knit-de-knitting technique, or by air jet texturing, the bulk continuous filament (BCF) gas jet process, twist processes such as the false twist process, stuffer box crimping, and bicomponent structures. The skilled person will be able to select the optimal texturing process for the desired purpose. For example, for apparel textiles it may be use of the false twist texturing machine, for staple fiber it might be stuffer box crimping, and for carpet yarns it might be the BCF gas jet process.

The drawn fiber may be subjected to a so-called spin finishing step. Thereto, the drawn fiber is treated with a suitable liquid. The skilled person has at his disposal a wide variety of liquids depending on the property that is to be added to the fiber. The spin finishing liquid may provide for example lubrication or static charge reduction. The liquid may therefore be a lubricant, an anti-static agent and/or an emulsifier. Additionally, it may include adhesion promoters, corrosion inhibitors, antibacterial components and/or antioxidants.

As most fiber applications require the fibers to be colored in any color possible, PEF fibers can be dyed using dyeing techniques such as for example but not limited to carrier or carrier free dyeing, high temperature and high pressure (HTHP) dyeing, thermosol dyeing, plasma techniques, solvent free, supercritical $CO_2$-based dyeing or dyeing using swelling agents. Also modifications can be made to the PEF polymer to improve the dyeability of PEF fibers. Polymerizing a third monomer can produce a functionalized dyeable polyester chain. This third monomer has introduced functional groups as the sites to which for example cationic dyes can be attached. The third monomer can contribute to disturbing the regularity of PEF polymer chains, so as to make the structure of dyeable polyester less compact than that of normal PEF fibers. The disturbed structure is good for the penetration of dyes into the fiber. Accordingly, the polyethylene-2,5-furan-dicarboxylate has preferably been modified by the introduction of a third monomer to facilitate dyeing, which third monomer contains functionalized groups or disturbs the regularity of the chain of the polyethylene-2,5-furan-dicarboxylate. Also a disperse dye in a microemulsion can be used for dyeing PEF.

The process according to the present invention provides for the first time a fiber that not only contains polyethylene-2,5-furandicarboxylate, but that has also a fineness as measured by the linear density that has not been provided in the prior art. Accordingly, the present invention also provides a fiber comprising polyethylene-2,5-furan-dicarboxylate having a linear density of 0.05 to 2.0 tex. Such a fiber is surprising since the fibers comprising polytrimethylene-2,5-furandicarboxylate do not allow the easy manufacture of fibers with similar linear density having similar tenacity. Preferably, the fibers have a linear density in the range of 0.05 to 0.5 tex. Such fibers are excellently suitable for textile purposes, and show excellent mechanical properties.

It is surprising that the fibers not only have a desirable linear density, but that they also have desirable mechanical properties. In particular, the fibers show a desirable tenacity. Suitably the fiber has a tenacity ranging from 200 to 1,000 mN/tex.

As indicated above, the tenacity of the fiber is improved if the molecular weight of the polyethylene-2,5-furandicarboxylate is increased. It has also already been described that the molecular weight of the polymer in the yarn may differ from the molecular weight of the polymer in the molten composition. Therefore, the polyethylene-2,5-furandicarboxylate has preferably a weight average molecular weight in the range of 40,000 to 100,000, more preferably from 50,000 to 95,000, more preferably from 55,000 to 90,000. Most preferably, the weight average molecular weight of the fiber ranges from 65,000 to 90,000. Fibers with the latter molecular weights have shown to have very good tenacity. Expressed in intrinsic viscosity, the intrinsic viscosity is preferably in the range from 0.45 to 0.85 dl/g as determined above, in dichloroacetic acid at 25° C. The tenacity is also improved if the orientation and/or crystallization of the polymers in the fiber has been enhanced. Such enhanced orientation can be achieved by drawing a spun fiber. The drawing may be done in one step, but it is also possible to conduct the drawing of a fiber in several steps, e.g. two to four. Such multistep procedure has the advantage that each step of drawing of the fiber may be conducted at different temperatures, dependent on the desired draw ratio and/or mechanical property. As indicated above, the draw temperatures are preferably in the range of 50 to 180° C. The fiber has therefore preferably been obtained by drawing an undrawn spun fiber at a draw ratio of 1:1.4 to 1:6.0. It is to be understood that if the drawing is done in several steps then the resulting overall draw ratio is the multiplicative product of the draw ratio of each of the individual steps. The drawing may be conducted either in-line with the spinning process, as part of a continuous operation, or it may be conducted in a separate step where the as-spun yarn has first been wound and collected onto a bobbin or roller, and then is subsequently unwound and drawn to its final form.

The present inventors have found that polyethylene-2,5-furan-dicarboxylate polymers are very slow to crystallize. In the absence of significant orientation caused through drawing, the polymer will crystallize only very slowly. For example, when a polyethylene-2,5-furan-dicarboxylate polymer is cooled from above its melting point at a rate of 30° C./min, 20° C./min, 10° C./min, or even only 5° C./min, no crystallinity is developed on the cool-down. It was further found that polyethylene-2,5-furan-dicarboxylate does crystallize readily when it is drawn and oriented. As a result, the appearance of crystallinity in a fiber can be taken as evidence that the fiber was subjected to a drawing process. Drawn fibers of a polyethylene-2,5-furan-dicarboxylate composition typically exhibit crystallinity of more than 5 J/g, and often more than 10 J/g, as determined by DSC (Differential Scanning Calorimetry). The reported crystallinity is determined by the net crystallinity from an upheat of the fiber by DSC, being the total melting endotherm less any crystallization exotherm exhibited on the upheat. This represents the crystallinity of the fiber. The crystallinity, as expressed in J/g and determined by DSC, is preferably more than 30 J/g since fibers with such a level of crystallinity show low shrinkage, e.g. less than 10% shrinkage in length when placed in boiling water. The crystallinity may be as high as 50 J/g.

The spinning and drawing processes for polyethylene-2,5-furan-dicarboxylate polymer give rise to an amount of crystallinity in the fiber. The fiber properties can be further controlled and optimized by applying a step of heat-setting to the drawn (and, if desired, textured) fiber yarn. This step can be accomplished through the use of dry hot air, saturated or superheated steam, hot rolls, hot plates, and so forth. The orientation already developed in the fiber or yarn through the spinning and drawing process leads to a rapid development of a crystalline network. The process can be carried out either under tension or without tension, as known in the art, to modify final fiber or yarn properties, such as hot air shrinkage, elongation to break, tenacity, and crimp retention.

Birefringence is an optical property, given by the difference of the value of the refractive index in two directions. For fibers it is measured perpendicular and parallel to the fiber axis. It is a useful measure of the degree of orientation in a fiber. A fiber which experiences no draw during either spinning or in a post-drawing operation will have no orientation and it will have a birefringence of virtually zero. A polyethylene-2,5-furan-dicarboxylate fiber according to the present invention that has been drawn, has a level of birefringence which is greater than zero, due to the preferential orientation of the polymer chains in the direction of the drawing. Fibers according to the invention preferably have a birefringence value of greater than 0.01 and more preferably greater than 0.03. The upper limit may be as high as 0.4.

The fiber may consist essentially of polyethylene-2,5-furandicarboxylate. However, as suggested above, the fiber may also comprise mixtures of other polymers with polyethylene-2,5-furan-dicarboxylate. Such other polymers include polyolefins, such as polyethylene and polypropylene, polyamides, such as nylon-6,6 and nylon-6, and polyesters, such as polyethylene terephthalate (PET) and polyethylene-naphthalate (PEN). Especially mixtures with PET or PEN are preferred. Therefore, the fiber suitably comprises from 75 to 100% wt polyethylene-2,5-furan-dicarboxylate, based on the weight of the fiber. In the recycling of PET it possible to combine recycled PET with amounts of suitably up to 15% wt of polyethylene-2,5-furan-dicarboxylate, without deteriorating the PET properties, and at the same time providing the mixture obtained with the properties of polyethylene-2,5-furan-dicarboxylate. Accordingly, the fiber according to the present invention suitably further comprises polyethylene terephthalate or polyethylene naphthalate, preferably in an amount of 99 to 85% wt, based on the total fiber.

The fibers according to the present invention are suitably combined into a yarn, yielding a yarn comprising a plurality of such fibers.

The fibers and yarns may be used for all different fiber applications. Such includes the application in textiles, which may be knit, woven or non-woven. Hence, it may be admixed with wool or cotton for the manufacture of clothes or carpets. It can also be used in furniture upholstery or curtains. Alternatively it may be used as technical fiber, e.g. in safety belts, in transportation belts, or as reinforcement in tires, so-called tire cords. It may also be reinforced by combination with glass fibers etc.

The invention will be further illustrated by means of the following examples.

EXAMPLE 1

A sample of polyethylene-2,5-furandicarboxylate (hereinafter "PEF") having a weight average molecular weight Mw of 75,600 determined by GPC with polystyrene standards, corresponding with an intrinsic viscosity of 0.74 dl/g, was melt spun in via a 48-hole spinneret at a temperature of 260° C. The molten threads were cooled and spun. The 48 filaments were combined to a yarn having a linear density of 115 tex, corresponding with a linear density of 2.40 tex per filament. The breaking tenacity was 96 mN/tex and the elongation to break was 239%. (both as determined according to ISO 5079-1995). The yarn as spun was subjected to stretching (drawing) to different draw ratios and at different draw temperatures. The yarn had an IV of 0.67 dl/g, corresponding with a weight average molecular weight of 66,400. The resulting linear densities per filament, breaking tenacities and elongations at break are shown in the Table 1 below.

TABLE 1

| Exp. No. | Temperature, ° C. | Draw ratio | Linear density, tex | Tenacity, mN/tex | Elongation, % |
|---|---|---|---|---|---|
| 1 | 90 | 1.5 | 1.59 | 156 | 137 |
| 2 | 90 | 2 | 1.20 | 209 | 83 |
| 3 | 90 | 2.5 | 0.98 | 247 | 46 |
| 4 | 90 | 3 | 0.80 | 319 | 25 |
| 5 | 100 | 1.5 | 1.58 | 146 | 148 |
| 6 | 100 | 2 | 1.20 | 186 | 85 |
| 7 | 100 | 2.5 | 0.96 | 230 | 53 |
| 8 | 100 | 3 | 0.77 | 287 | 27 |
| 9 | 110 | 1.5 | 1.57 | 123 | 139 |
| 10 | 110 | 2 | 1.19 | 153 | 94 |
| 11 | 110 | 2.5 | 0.95 | 182 | 61 |
| 12 | 110 | 3 | 0.56 | 269 | 22 |
| 13 | 120 | 1.5 | 1.59 | 116 | 138 |
| 14 | 120 | 2 | 1.19 | 199 | 108 |
| 15 | 120 | 2.5 | 0.95 | 220 | 75 |
| 16 | 120 | 3 | 0.81 | 293 | 28 |

The above results show that PEF fibers with good linear densities and excellent strengths can be obtained. The results further show that when the draw temperature is 100° C. or below, the tenacity increases whereas the elongation does not seem to vary over temperature. The higher the draw ratio is, the better is the tenacity and the lower is the elongation at break.

EXAMPLE 2

The same polymer that was used in Example 1 was subjected to a two-step stretching (drawing) process. First the polymer composition was melt spun in the same way as was done in Example 1. A resulting yarn was subsequently preliminarily drawn at 85° C. to a draw ratio of 2.5. In a second stage the preliminarily drawn fiber was further drawn to different final draw ratios in an oven heated to 125 or 130° C. The tenacity and elongation was again determine for each of the resulting yarns. The results are shown in Table 2.

TABLE 2

| Exp. No. | Temperature, ° C. | Final draw ratio | Linear density, tex | Tenacity, mN/tex | Elongation, % |
|---|---|---|---|---|---|
| 17 | 125 | 2.75 | 0.92 | 161 | 25 |
| 18 | 125 | 3 | 0.84 | 210 | 15 |
| 19 | 125 | 3.25 | 0.78 | 263 | 14 |
| 20 | 130 | 2.75 | 0.90 | 150 | 17 |
| 21 | 130 | 3 | 0.81 | 237 | 13 |
| 22 | 130 | 3.25 | 0.78 | 270 | 14 |

The results indicate that after a first draw step at relatively low temperature a second step at a higher temperature can be carried out, wherein the variation of the temperature in the second step in the region of 125 to 130° C. hardly plays a role.

EXAMPLE 3

The same polymer that was used in Example 2 and melt spun in the same way. In a first step the spun fibers were drawn at 90° C. to a first draw ratio of 2.4. Then the preliminarily drawn fibers were passed over a hot plate kept at 100° C. and drawn further to a final draw ratio ranging from 3 to 3.6. The results of these experiments are shown in Table 3.

TABLE 3

| Exp. No. | Final draw ratio | Linear density, tex | Tenacity, mN/tex | Elongation, % |
|---|---|---|---|---|
| 23 | 3 | 0.87 | 345 | 22 |
| 24 | 3.2 | 0.81 | 368 | 13 |
| 25 | 3.4 | 0.76 | 429 | 5.4 |
| 26 | 3.6 | 0.72 | 485 | 5.4 |

The results show that when the draw temperature also in the second step is at most 100° C., the tenacity of the resulting fibers is increased. The yarn showed a melting point of 204-210° C. The crystallinity of the yarn of Experiment No. 23, determined by the net enthalpy of melting via Differential Scanning Calorimetry (DSC), amounted to 14 J/g. The crystallinity of the yarn of Experiment No. 26 amounted to 30 J/g.

EXAMPLE 4

Two samples of PEF, one having a Mw of 85,200 ("sample A"), corresponding with an intrinsic viscosity of 0.81 dl/g, and the second having a Mw of 111,000 ("sample B"), corresponding with an intrinsic viscosity of 0.99 dl/g, were melt spun in via a 48-hole spinneret at a temperature of 260° C. The 48 filaments were combined to yarns, one having a linear density of 144.2 tex, corresponding with a linear density of 3.00 tex per filament (yarn from Sample A), and the second having a linear density of 143.3 tex, corresponding with a linear density of 2.99 tex per filament (yarn from Sample B). The yarn from Sample A as spun had an IV of 0.71 dl/g, corresponding with a Mw of 71,600, and the yarn as spun from Sample B had an IV of 0.82, corresponding with a Mw of 86,600. The yarns as spun were subjected to stretching (drawing) to different draw ratio in one or two steps. The draw temperature in the first step was 90° C.; the temperature at the second step was 100 or 150° C. The resulting linear densities per filament, breaking tenacities and elongations at break are shown in the Table 4 below.

TABLE 4

| Exp. No. | Sample | T, ° C. $2^{nd}$ step, | DR, $1^{st}$ step | DR, $2^{nd}$ step | Linear density, tex | Tenacity, mN/tex | Elongation, % | Bi-refringence Δn, $10^{-3}$ | Crystallinity, J/g |
|---|---|---|---|---|---|---|---|---|---|
| 27 | A | — | 2 | — | 1.45 | 207 | 112 | 33.8 | 2 |
| 28 | A | — | 2.5 | — | 1.15 | 253 | 60 | | |
| 29 | A | — | 3 | — | 0.98 | 289 | 38 | 66.4 | 8 |
| 30 | A | — | 3.5 | — | 0.88 | 336 | 21 | | |
| 31 | A | — | 4 | — | 0.71 | 409 | 6 | 142.6 | 45 |
| 32 | B | — | 2 | — | 1.48 | 239 | 63 | 37.6 | |
| 33 | B | — | 2.5 | — | 1.19 | 302 | 34 | | |
| 34 | B | — | 3 | — | 1.03 | 325 | 11 | 101.3 | 34 |
| 35 | B | — | 3.5 | — | 0.94 | 447 | 4.9 | 118.0 | 40 |
| 36 | A | 100 | 2.5 | 1 | 1.22 | 253 | 72 | 45.1 | 2 |
| 37 | A | 100 | 2.5 | 1.2 | 1.02 | 283 | 43 | 64.3 | 1 |
| 38 | A | 100 | 2.5 | 1.4 | 0.88 | 331 | 25 | | |
| 39 | A | 100 | 2.5 | 1.6 | 0.78 | 399 | 8 | | |
| 40 | A | 100 | 2.5 | 1.8 | 0.70 | 530 | 5.7 | | 33 |
| 41 | B | 100 | 2 | 1.25 | 1.21 | 307 | 34 | 80.9 | 3 |
| 42 | B | 100 | 2 | 1.5 | 1.02 | 347 | 12 | 13.6 | 8 |
| 43 | B | 100 | 2 | 1.6 | 0.98 | 422 | 5.6 | 117.3 | 17 |
| 44 | A | 150 | 2.5 | 1 | 1.19 | 153 | 116 | 16.6 | 2 |
| 45 | A | 150 | 2.5 | 1.2 | 1.00 | 156 | 87 | 27.8 | 19 |
| 46 | A | 150 | 2.5 | 1.4 | 0.88 | 312 | 30 | 121.4 | 39 |
| 47 | A | 150 | 2.5 | 1.6 | 0.76 | 410 | 4 | 147.5 | 42 |
| 48 | A | 150 | 2.5 | 1.8 | 0.68 | 625 | 4.9 | 170.8 | 45 |
| 49 | B | 150 | 2.5 | 1 | 1.23 | 280 | 37 | 98.4 | 39 |
| 50 | B | 150 | 2.5 | 1.2 | 1.01 | 324 | 6 | 136.3 | 39 |
| 51 | B | 150 | 2.5 | 1.28 | 0.96 | 404 | 4.6 | 137.0 | 46 |
| 52 | B | 150 | 2.5 | 1.36 | 0.90 | 381 | 6 | | 39 |

The results show that when PEF fibers have a Mw 75,000, they have even higher tenacity.

EXAMPLE 5

A sample of PEF having a weight average molecular weight Mw of 89,500, corresponding with an intrinsic viscosity of 0.84 dl/g, was melt spun via a 48-hole spinneret at a temperature of 290° C. The molten threads were cooled and spun. The 48 filaments were combined to a yarn having a linear density of 13 tex. The IV of the yarn was 0.71 dl/g, corresponding with an Mw of 71.800.

The yarn was processed on a Barmag AFK 2 false twist texturing machine to produce textured drawn yarns. Thereto the spun yarn is heated in the texturing machine in an oven, heated to 160 or 170° C. so that it becomes malleable. In this state, it is drawn with a draw ratio of 1.6 or 1.7, and is twisted. Subsequently, the thread is cooled by means of a jet of air and the twist reversed, which creates crimping. At the end of this continuous process, the thus textured yarn is wound. The yarns with a draw ratio of 1.6 had an average linear density of 0.17 tex, the yarns with a draw ratio of 1.7 had an average linear density of 0.16 tex. Samples of the textured yarns were measured as to tenacity and elongation at break. The results, showing the average of 30 samples for each parameter, are shown in Table 5.

TABLE 5

| Exp. No. | Temperature, ° C. | Draw ratio | Tenacity, mN/tex | Elongation, % |
|---|---|---|---|---|
| 53 | 160 | 1.6 | 302 | 23 |
| 54 | 160 | 1.7 | 300 | 8 |
| 55 | 170 | 1.6 | 288 | 20 |
| 56 | 170 | 1.7 | 289 | 15 |

This example shows that textured yarns can be made with satisfactory tenacity.

EXAMPLE 6

A sample of PEF, having an intrinsic viscosity of 0.66 dl/g, was used in a number of mixtures with polyethylene terephthalate ("PET"). The PET used had an intrinsic viscosity of 0.64 dl/g. The polymer, or polymer mixture, was melted to a temperature of 270° C. and melt spun via a 72-hole spinneret at a temperature of 270° C. The molten threads were cooled. The 72 filaments were combined to a yarn. The yarns were drawn in three steps at 60, 100 and 100° C. to a final draw ratio of 2.5. The linear densities per filament of the yarns were determined and found to be 0.56±0.01 tex. In addition to the tenacity and elongation, also the maximum draw ratio was determined by drawing the yarns in the third step till they broke. The results are shown in Table 6.

TABLE 6

| Exp. No. | PET, % wt | PEF, % wt | Tenacity, mN/tex | Elongation, % | Maximum draw ratio |
|---|---|---|---|---|---|
| 57 | 100 | 0 | 145 | 67.2 | 4.2 |
| 58 | 99 | 1 | 151 | 59.7 | 4.2 |
| 59 | 98 | 2 | 166 | 58.2 | 4.2 |
| 60 | 95 | 5 | 158 | 56.7 | 4.4 |
| 61 | 90 | 10 | 138 | 69.6 | 4.2 |
| 62 | 80 | 20 | 134 | 64.6 | 4.2 |

The result show that PEF can successfully mixed with PET in various amounts to yield fibers with properties that are similar to those of PET. When the amount of PEF is up to 10% wt, the tenacity is even further improved.

COMPARATIVE EXAMPLE 7

A sample of polytrimethylene-2,5-furandicarboxylate (also known as polypropylene-2,5-furandicarboxylate, hereinafter "PPF"), was prepared with a number average molecular weight of 30,000. The melting temperature of the polymer was about 178-179° C. Because of the lower melting temperature the polymer was melted to a temperature of 210° C. and melt spun via a 48-hole spinneret. The molten threads were cooled and spun. The 48 filaments were combined to a yarn having a linear density of 110 tex, corresponding with a linear density of 2.29 tex per filament. During spinning the pressure in the spinneret increased such that the spinning had to be interrupted.

The yarns were drawn at different temperatures. Since the glass transition temperature of PPF is about 50-51° C., the draw temperature can be lower than for PEF. Temperatures below 60° C. resulted in yarn breaks. Drawing at a temperature above 80° C. resulted in an undesirably low level of orientation and crystallization in the fiber. Therefore, the draw temperatures were kept between 60 and 80° C.

The yarns obtained were drawn at different draw ratios ("DR") in two steps at different temperatures. The draw conditions and the resulting tenacity of the yarns are shown in Table 7.

TABLE 7

| Exp. No. | DR, 1st step | Temperature, 1st step, ° C. | DR, 2nd step | Temperature, 2nd step, ° C. | Linear density, tex | Tenacity, mN/tex | Elongation, % |
|---|---|---|---|---|---|---|---|
| 63 | 2 | 62 | 2 | 70 | 0.59 | 130 | 21 |
| 64 | 2 | 62 | 2.25 | 70 | 0.53 | 100 | 14 |

The results show that when a PPF fiber has been spun and drawn to a linear density of about 0.5 to 0.6 tex, the tenacity is unsatisfactorily low.

EXAMPLE 8

A sample of PEF having a weight average molecular weight Mw of 57,700, corresponding with an intrinsic viscosity of 0.60 dl/g, was melt spun via a 48-hole spinneret at a temperature of 264° C. The molten threads were cooled, picked up on a roller rotating at a speed of 1500 rpm, and spun. The 48 filaments were combined to a yarn having a linear density of 33.4 tex, corresponding with a linear density of 0.70 tex per filament. The IV of the yarn was 0.48 dl/g, corresponding with an Mw of 43,100.

The yarn was drawn at 110° C., followed by a heat set at 155° C. The resulting yarns and an crystallinity of more than 40 J/g, a Tg of about 80° C. and a melting temperature of 212° C. The shrinkage in boiling water was less than 5%. Other properties of the yarn are shown in Table 8.

TABLE 8

| Exp. No. | Draw ratio | Linear density, tex | Tenacity, mN/tex | Elongation, % |
|---|---|---|---|---|
| 65 | — (as spun) | 0.70 | 132 | 223 |
| 66 | 2.5 | 0.28 | 239 | 22 |

The invention claimed is:

1. A process for the preparation of a fiber comprising polyethylene-2,5-furan-dicarboxylate, by melt spinning, wherein a molten composition comprising polyethylene-2,5-furan-dicarboxylate having an intrinsic viscosity of at least 0.55 dl/g, determined in dichloroacetic acid at 25° C., is passed through one or more spinning openings to yield molten threads;

wherein the molten threads are cooled to below the melting temperature of the composition to yield spun fibers;

wherein the spun fibers are drawn to a linear density in the range of 0.05 to 2.0 tex per fiber;

wherein the molten composition further comprises at least one polymer different from polyethylene-2,5-furan-dicarboxylate; and wherein the molten composition further comprises polyethylene terephthalate or polyethylene naphthalate.

2. The process according to claim 1, wherein the molten composition comprises from 75 to 100% wt polyethylene-2,5-furan-dicarboxylate, based on the weight of the molten composition.

3. The process according to claim 1, wherein the at least one polymer different from polyethylene-2,5-furan-dicarboxylate has been selected from polyolefins, polyamides, polyesters and combinations thereof.

4. The process according to claim 1, wherein the at least one polymer different from polyethylene-2,5-furan-dicarboxylate is present in an amount of 99 to 75% wt or 1 to 25% wt, based on the weight of the at least one polymer different from polyethylene-2,5-furan-dicarboxylate and polyethylene-2,5-furan-dicarboxylate.

5. The process according to claim 1, wherein the spun fibers are drawn in a secondary drawing step at a draw ratio of 1:1.4 to 1:6.0.

6. The process according to claim 1, wherein the spun fibers are combined to a multifilament yarn before or after being drawn.

7. The process according to claim 1, wherein the molten composition is kept at a temperature of 20 to 70° C. above the melting temperature of the molten composition.

8. The process according to claim 1, wherein the spun fibers are drawn at a temperature of between glass transition temperature and the melting temperature of the polymer composition.

9. The process according to claim 1, wherein the polyethylene-2,5-furan-dicarboxylate has an intrinsic viscosity in the range of 0.55 to 1.55 dl/g, determined in dichloroacetic acid at 25° C.

10. The process according to claim 1, wherein the spun fibers are textured.

11. The process according to claim 1, wherein the fibers after drawing are subjected to a spin finishing step by treating the fibers with a liquid.

12. The process according to claim 1, wherein the fibers after drawing are subjected to a dyeing technique.

13. The process according to claim 1, wherein the polyethylene-2,5-furan-dicarboxylate has been modified by the introduction of a third monomer to facilitate dyeing, which third monomer contains functionalized groups or disturbs the regularity of the chain of the polyethylene-2,5-furan-dicarboxylate.

14. A fiber comprising polyethylene-2,5-furan-dicarboxylate having a linear density of 0.05 to 2.0 tex, wherein the polyethylene-2,5-furan-dicarboxylate has an intrinsic viscosity of at least 0.45 dl/g, determined in dichloroacetic acid at 25° C., wherein the fiber further comprises at least one polymer different from polyethylene-2,5-furan-dicarboxylate, and wherein the fiber further comprises polyethylene terephthalate or polyethylene naphthalate.

15. The fiber according to claim 14, having a linear density of 0.05 to 0.5 tex.

16. The fiber according to claim 14, which has a tenacity of 200 to 1,000 mN/tex.

17. The fiber according to claim 14, wherein the polyethylene-2,5-furan-dicarboxylate has an intrinsic viscosity in the range of 0.45 to 0.85 dl/g, determined in dichloroacetic acid at 25° C.

18. The fiber according to claim 14, wherein the fiber has a birefringence in the range of 0.01 to 0.4.

19. The fiber according to claim 14, wherein the fiber has a crystallinity of at least 5 J/g as determined by Differential Scanning calorimetry (DSC).

20. The fiber according to claim 14, wherein the fiber has been obtained by drawing an undrawn spun fiber at a draw ratio of 1:1.4 and 1:6.0 in a secondary drawing step.

21. The fiber according to claim 14, which has been dyed by a dyeing technique.

22. A yarn, comprising a plurality of fibers according to claim 14.

23. A knit, woven or non-woven article, comprising a yarn according to claim 22.

24. The article according to claim 23, which is selected from a textile, a carpet and a tire cord.

25. The process according to claim 1, wherein the molten composition further comprises polyethylene terephthalate or polyethylene naphthalate in an amount of 99 to 85% wt, based on the total composition.

26. The process according to claim 12, wherein the fibers after drawing are subjected to a dyeing technique selected from the group consisting of carrier or carrier free dyeing, high temperature and high pressure (HTHP) dyeing, thermosol dyeing, plasma techniques, solvent free, supercritical $CO_2$-based dyeing, dyeing using swelling agents and combinations thereof.

27. The fiber according to claim 19, wherein the fiber has a crystallinity of at least 30 J/g, as determined by Differential Scanning calorimetry (DSC).

28. The fiber according to claim 24, wherein the fiber further comprises polyethylene terephthalate or polyethylene naphthalate in an amount of 99 to 85% wt, based on the total fiber.

29. The fiber according to claim 21, which has been dyed by a dyeing technique selected from the group consisting of carrier or carrier free dyeing, high temperature and high pressure (HTHP) dyeing, thermosol dyeing, plasma techniques, solvent free, supercritical $CO_2$-based dyeing, dyeing using swelling agents and combinations thereof.

30. The process according to claim 25, wherein the molten composition further comprises polyethylene terephthalate or polyethylene naphthalate in an amount of 99 to 90% wt, based on the total composition.

31. The fiber according to claim 28, wherein the fiber further comprises polyethylene terephthalate or polyethylene naphthalate in an amount of 99 to 90% wt, based on the total fiber.

* * * * *